US011761657B2

(12) United States Patent
Wang et al.

(10) Patent No.: US 11,761,657 B2
(45) Date of Patent: Sep. 19, 2023

(54) DATA SENDING METHOD, MULTI-CONNECTED SYSTEM, ELECTRONIC DEVICE AND STORAGE MEDIUM

(71) Applicant: Gree Electric Appliances, Inc. of Zhuhai, Guangdong (CN)

(72) Inventors: Wencan Wang, Guangdong (CN); Dongfeng Lai, Guangdong (CN); Jie Tang, Guangdong (CN); Tieying Ye, Guangdong (CN); Weiyou Yu, Guangdong (CN); Du Yang, Guangdong (CN); Zhongwen Deng, Guangdong (CN); Yang Zhang, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 337 days.

(21) Appl. No.: 17/046,977

(22) PCT Filed: Dec. 10, 2018

(86) PCT No.: PCT/CN2018/120124
§ 371 (c)(1),
(2) Date: Oct. 12, 2020

(87) PCT Pub. No.: WO2019/196453
PCT Pub. Date: Oct. 17, 2019

(65) Prior Publication Data

US 2021/0156584 A1 May 27, 2021

(30) Foreign Application Priority Data

Apr. 13, 2018 (CN) ..... 201810333209.8

(51) Int. Cl.
*F24F 11/54* (2018.01)
*F24F 11/64* (2018.01)
*F24F 11/88* (2018.01)

(52) U.S. Cl.
CPC ..... *F24F 11/54* (2018.01); *F24F 11/64* (2018.01); *F24F 11/88* (2018.01)

(58) Field of Classification Search
CPC ..... F24F 11/54; F24F 11/64; F24F 11/88
See application file for complete search history.

(56) References Cited

U.S. PATENT DOCUMENTS

2005/0002408 A1 1/2005 Lee
2005/0005619 A1* 1/2005 Kojima ..... F24F 11/871 700/277

(Continued)

FOREIGN PATENT DOCUMENTS

CN 201866892 U * 6/2011
CN 201866892 U 6/2011

(Continued)

OTHER PUBLICATIONS

Translation of CN-107763803-A.*
Translation of CN-201866892-U.*

*Primary Examiner* — Mohammad Ali
*Assistant Examiner* — Vincent W Chang
(74) *Attorney, Agent, or Firm* — The Webb Law Firm

(57) ABSTRACT

Disclosed are a data sending method, a multi-connected system, an electronic device and a storage medium. The method includes: receiving data sent by a first specified line controller in a system; determining a specified device corresponding to the first specified line controller according to a pre-stored pairing relationship between the first specified line controller and a specified device and the first specified line controller, wherein the specified device includes an indoor unit and a second specified line controller, wherein (Continued)

the second specified line controller is different from the first specified line controller; and sending the data to the determined specified device. A plurality of line controllers can control one indoor unit.

5 Claims, 2 Drawing Sheets

(56) References Cited

U.S. PATENT DOCUMENTS

| | | | | |
|---|---|---|---|---|
| 2009/0151382 | A1 | 6/2009 | Okano et al. | |
| 2012/0101778 | A1* | 4/2012 | Gyota | F24F 11/38 702/183 |
| 2014/0324231 | A1 | 10/2014 | Kawai | |
| 2015/0120003 | A1* | 4/2015 | Kobori | G05B 15/02 700/19 |
| 2015/0308707 | A1* | 10/2015 | Tanaka | G05B 15/02 700/276 |
| 2016/0265799 | A1 | 9/2016 | Matsuno et al. | |
| 2018/0058712 | A1* | 3/2018 | Miyaura | F24F 11/30 |
| 2019/0041080 | A1* | 2/2019 | Higuchi | F24F 11/30 |
| 2020/0232672 | A1* | 7/2020 | Cha | F24F 11/30 |
| 2022/0333793 | A1* | 10/2022 | Kotake | F24F 11/64 |

FOREIGN PATENT DOCUMENTS

| | | | | |
|---|---|---|---|---|
| CN | 102322672 | A | | 1/2012 |
| CN | 104089370 | A | | 10/2014 |
| CN | 104776572 | A | | 7/2015 |
| CN | 107763803 | A | * | 3/2018 |
| CN | 107763803 | A | | 3/2018 |
| CN | 108418606 | A | | 8/2018 |
| CN | 108592302 | A | | 9/2018 |
| CN | 208015725 | U | | 10/2018 |
| CN | 208241667 | U | | 12/2018 |
| EP | 3141833 | A1 | | 3/2017 |
| WO | 2016000428 | A1 | | 1/2016 |

* cited by examiner

DATA SENDING METHOD, MULTI-CONNECTED SYSTEM, ELECTRONIC DEVICE AND STORAGE MEDIUM

CROSS-REFERENCE TO RELATED APPLICATIONS

This application is the United States national phase of International Application No. PCT/CN2018/120124 filed Dec. 10, 2018, and claims priority to Chinese Patent Application No. 201810333209.8 filed Apr. 13, 2018, the disclosures of which are hereby incorporated by reference in their entirety.

BACKGROUND OF THE INVENTION

Field of the Invention

The embodiments of the present disclosure relate to the field of air conditioning, and specifically, to a data sending method, a multi-connected system, an electronic device, and a storage medium.

Description of Related Art

Devices such as outdoor units, indoor units and line controllers of a multi-connected system in the related art use communication manners such as CAN, 485 and HBS, but these communication manners require an installer to arrange dedicated communication lines, so that there are problems such as additional construction, complicated wiring, high cost and difficult maintenance. In order to solve the problems, there is proposed a multi-connected system which uses a power line carrier communication (PLC) method. That is, it is possible to implement communication between various devices of the multi-connected system with the existing power line. The inventors realized that multi-connected system in the related art still cannot meet the needs of users. For example, there are a plurality of doorways in one room, and a line controller needs to be installed next to each doorway to control a working state of an indoor unit in this room.

In view of the above-described problems, there has not been proposed an effective solution.

SUMMARY OF THE INVENTION

According to one aspect of the embodiments of the present disclosure, a data sending method is provided. The method comprises: receiving data sent by a first specified line controller in a system; determining a specified device corresponding to the first specified line controller according to a pre-stored pairing relationship between the first specified line controller and a specified device and the first specified line controller, wherein the specified device comprises an indoor unit and a second specified line controller, wherein the second specified line controller is different from the first specified line controller; and sending the data to the determined specified device.

According to another aspect of the embodiments of the present disclosure, a multi-connected system is provided. The system comprises: a central coordinator, a plurality of line controllers, and an indoor unit, which are connected to power lines of the multi-connected system, wherein: a specified line controller among the plurality of line controllers is configured to send data to the central coordinator; and the central coordinator is configured to store a pairing relationship between the plurality of line controllers and the indoor unit, and determine an indoor unit and other line controllers corresponding to the specified line controller according to the pairing relationship and the specified line controller after receiving the data, and send the data to the determined indoor unit and the other line controllers, wherein the other line controllers are other line controllers than the specified line controller among the plurality of line controllers.

According to another aspect of the embodiments of the present disclosure, it is provided a storage medium storing a computer program which implements the above-described data sending method during operation when executed by a processor.

According to another aspect of the embodiments of the present disclosure, an electronic device is provided. The device comprises a memory storing a computer program and a processor configured to run the computer program to execute the above-described data sending method.

BRIEF DESCRIPTION OF THE DRAWINGS

The accompanying drawings described herein are used to provide a further understanding of the embodiments of the present disclosure and constitute a part of the present application. The illustrative embodiments as well as the illustrations thereof in the embodiments of the present disclosure, which are used for explaining the embodiments of the present disclosure, do not constitute improper definitions on the embodiments of the present disclosure. In the accompanying drawings.

DESCRIPTION OF THE INVENTION

Figure 1:
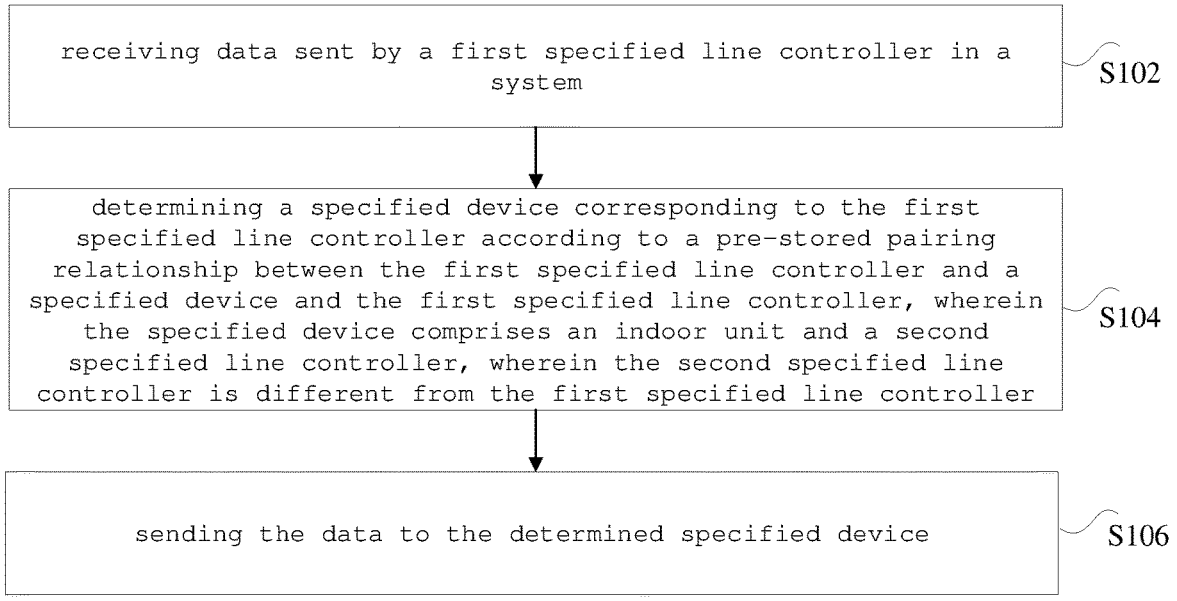
FIG. 1 is a schematic flowchart of a data sending method according to embodiments of the present disclosure.

In order to allow those skilled in the art to better understand the solution of the embodiments of the present disclosure, the technical solution in the embodiments of the present disclosure will be explicitly and completely described below in combination with the accompanying drawings in the embodiments of the present disclosure. Apparently, the described embodiments are merely part of the embodiments in the embodiments of the present disclosure, rather than all the embodiments. On the basis of the embodiments in the embodiments of the present disclosure, all the other embodiments acquired by those skilled in the art on the premise that no inventive effort is involved should fall into the protection scope of the embodiments of the present disclosure.

It should be noted that the terms "first", "second" and the like in the specification and claims of the embodiments of the present disclosure and the above-described accompanying drawings are configured to distinguish similar objects and are not necessarily used to describe a specific order or sequence. It is to be understood that the data thus used is interchangeable as appropriate, such that the embodiments of the present disclosure described here are implemented, in a sequence other than those illustrated or described here. In addition, the terms "comprise" and "have" as well as any of their deformations are intended to cover a non-exclusive inclusion. For example, the process, method, system, product, or device that contains a series of steps or units is not necessarily limited to those steps or units that are explicitly listed but can comprise other steps or units that are not explicitly listed or that are inherent to such processes, methods, products or devices.

In order to better understand the embodiments of the present application, the technical terms involved in the embodiments of the present application will be briefly described as follows.

Broadband power line carrier communication: the broadband power line carrier communication refers to power line carrier communication with a bandwidth limited between 2-30 MHz and a communication rate above 1 Mbps. For the broadband power line communication technology, there is no need to implement rewiring. With the existing power distribution network, in conjunction with some PLC offices, relays, terminal devices and auxiliary apparatuses, the initial power line network is converted into a power line communication network, and the initial power outlet is converted into an information outlet.

Outdoor unit: the outdoor unit in the air conditioning system, also referred to as a host, mainly consists of a compressor, a condenser, and a throttling device.

Indoor unit: an indoor unit in the air conditioning system. The devices placed indoors in the air conditioning system mainly consist of an evaporator, a fan, a control main board, and a casing.

According to embodiments of the present disclosure, embodiments of a data sending method is provided. It should be noted that the steps shown in the flowchart of the accompanying drawings are executed in a computer system such as a set of computer-executable instructions. Moreover, although a logical sequence is shown in the flowchart, in some cases, the steps shown or described are performed in a different sequence than here.

FIG. 1 is a schematic flowchart of a data sending method according to embodiments of the present disclosure. As shown in FIG. 1, the method comprises the following steps:

Step S102, receiving data sent by a first specified line controller in a system;

Step S104, determining a specified device corresponding to the first specified line controller according to a pre-stored pairing relationship between the first specified line controller and a specified device and the first specified line controller, wherein the specified device comprises an indoor unit and a second specified line controller, wherein the second specified line controller is different from the first specified line controller; and Step S106, sending the data to the determined specified device.

By means of the above-described steps, it is implemented by receiving data sent by a first specified line controller in a system; determining a specified device corresponding to the first specified line controller according to a pre-stored pairing relationship between the first specified line controller and a specified device and the first specified line controller, wherein the specified device comprises an indoor unit and a second specified line controller, wherein the second specified line controller is different from the first specified line controller; and sending the data to the determined specified device. That is, the second specified line controller and the indoor unit corresponding to the first specified line controller are determined according to the pre-stored pairing relationship between the first specified line controller and the specified device in advance, so as to achieve the purpose that a plurality of line controllers control one indoor unit, thereby solving the technical problem that multi-connected system based on the PLC communication in the related art cannot meet the needs of users.

It should be noted that, the above-described second specified line controller is one or plural and is not limited thereto.

It should be noted that, the above-described method further comprises establishing a pairing relationship before step S102.

It should be noted that, there are a plurality of methods to establish a pairing relationship. For example, a pairing relationship is established according to identification information of the specified line controller and the specified indoor unit, or a pairing relationship is established according to a working state of the indoor unit and the specified line controller. However, it is not limited thereto. The former is embodied as: receiving identification information of the specified device sent by a first specified line controller; obtaining identification information of the first specified line controller; and establishing the pairing relationship according to the identification information of the first specified line controller and the identification information of the specified device.

It should be noted that, the above-described identification information is a corresponding IP number, but is not limited thereto. For example, it is a MAC address.

It should be noted that, indoor units and line controllers in the above-described system display own IP numbers. Before receiving the identification information of the specified device sent by the first specified line controller, the above-described method also comprises that: the first line controller receives an instruction which carries identification information of the specified device.

It should be noted that, the above-described specified device comprises: one indoor unit, and one or more second specified line controllers, but is not limited thereto.

It should be noted that, after the above-described pairing relationship is established, it is possible to perform operation over the above-described pairing relationship. For example, the above-described pairing relationship is deleted, or a new pairing relationship is added. However, this is not limited thereto.

In some embodiments, the pairing relationship between the first specified line controller and the indoor unit and/or the second specified line controller in the above-described pairing relationship is deleted by deleting the identification information of the indoor unit or the identification information of the second specified line controller in the pairing relationship. However, this is not limited thereto. The pairing relationship between the above-described first specified line controller and a new indoor unit is established by adding the identification information of the new indoor unit, or the pairing relationship between the above-described first specified line controller and the above-described new specified line controller is established by adding the identification information of the new specified line controller.

The latter (establishing a pairing relationship according to the working states of the indoor unit and the first and second specified line controllers) is embodied as: receiving instruction information sent by the first specified line controller, wherein the instruction information is configured to indicate that the first specified line controller is in a to-be-paired state; obtaining a working state of the specified device in the system, wherein the working state comprises a to-be-paired state, a paired state, and an unpaired state; and pairing the specified device in the to-be-paired state with the first specified line controller to obtain the pairing relationship.

It should be noted that, the above-described indoor unit is provided with an infrared receiving device (such as an infrared receiver), and whether the above-described indoor unit is in the to-be-paired state is controlled by a remote controller. Specifically, it is embodied that: the remote controller sends a signal to the indoor unit, wherein the signal is configured to instruct the indoor unit to enter the to-be-paired state.

It should be noted that, after the above-described pairing relationship is established, it is also possible to perform operation over the above-described pairing relationship. For example, the above-described pairing relationship is deleted. However, this is not limited thereto. Specifically, it is embodied that: the remote controller sends a signal to the indoor unit, wherein the signal is configured to instruct to delete the pairing relationship between the indoor unit and the specified line controller. It is also embodied as: performing operation on the first specified line controller or the second specified line controller to cancel the pairing relationship between itself and other line controllers.

In order to allow that there is no need to re-pair the line controller and the indoor unit that have been paired after the system is powered on again after power-off, in some embodiments of the present disclosure, after the above-described pairing relationship is established, the above-described method further comprises: storing the above-described pairing relationship in a local electrically erasable programmable read only memory (EEPROM).

It should be noted that, the above-described pairing relationship is stored in the form of a table or in a text form but is not limited thereto.

It should be noted that, the execution subject of the above-described method is a Central Coordinator (referred thereto as CCO for short) but is not limited thereto. The above-described CCO is an outdoor unit in the above-described system but is not limited thereto.

In order to better understand the embodiments of the present disclosure, the embodiments of the present disclosure will be further explained below in conjunction with some embodiments.

Figure 2:
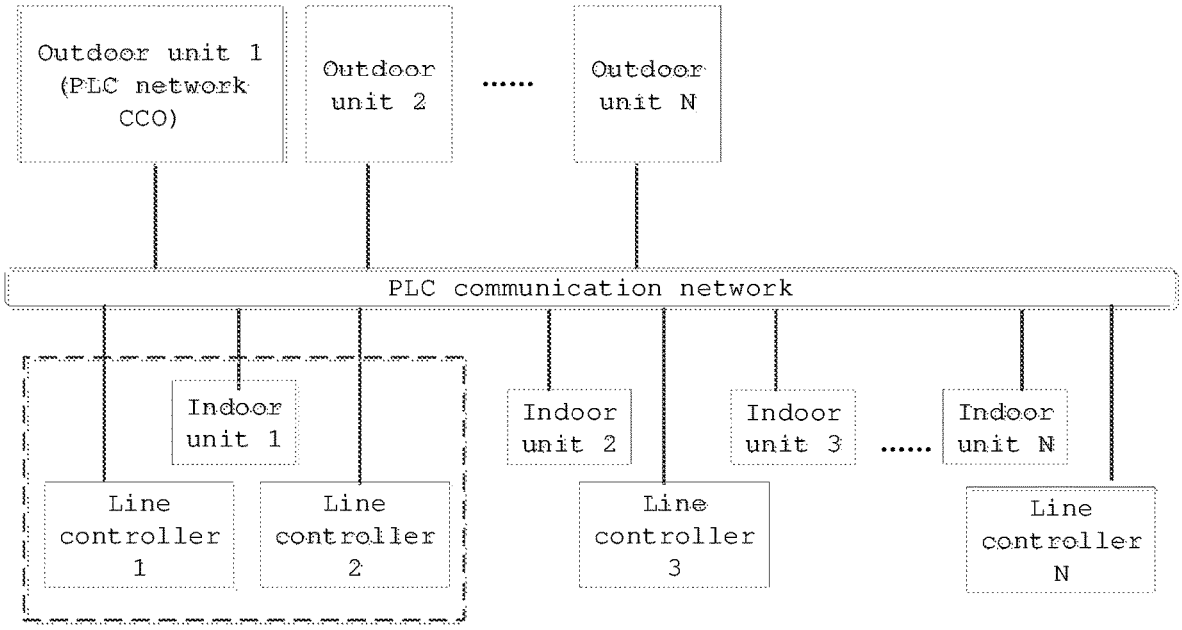
FIG. 2 is a network structure view of multi-connected system based on PLC communication according to some embodiments of the present disclosure.

FIG. 2 is a network structure view of a multi-connected system based on PLC communication provided according to some embodiments of the present disclosure. As shown in FIG. 2, in one multi-connected system based on PLC communication, there are a plurality of outdoor units, a plurality of indoor units, and a plurality of line controllers. The outdoor units, indoor units, and line controllers are connected by power lines, and each device has an independent physical address (Media Access Control, referred thereto as MAC for short). All the devices constitute one network independent of other multi-connected systems based on PLC communication by means of a PLC networking mechanism, wherein one of the outdoor units (the outdoor unit 1 as shown in FIG. 2) serves as the CCO of the PLC network. After one network is constituted, the CCO assigns each indoor unit and line controller with one unique IP number in the network to identify each network device. The devices in the network receive and send data through the power line, and if a certain device needs to send data to a specified target device, then such device first sends the data, and the CCO (e.g., the outdoor unit 1) after receiving the data forwards the data to a corresponding target device which executes a corresponding action after receiving the data of the CCO.

It should be noted that, the above-described method shown in FIG. 1 is applied to the network architecture of the above-described multi-connected system shown in FIG. 2. At this time, one of the line controller 1 and the line controller 2 shown in FIG. 2 is equivalent to the first specified line controller in the above-described embodiments, and the other is equivalent to the second specified line controller in the above-described embodiments. The indoor unit shown in FIG. 2 is equivalent to the indoor unit in the above-described embodiments. However, this is not limited thereto.

Since all the indoor units and line controllers are connected to the same PLC network, if a plurality of line controllers are required to jointly control the indoor unit, it is necessary to first pair the corresponding indoor unit with a plurality of line controllers. There are many pairing methods, for example in the following two methods:

Method 1: the indoor units and line controllers display own IP numbers. That is, the above-described indoor units and line controllers have display modules that display a plurality of digits. Then, IPs of other line controllers required to be paired are input on one of the line controllers, wherein IPs of a plurality of line controllers other than this line controller and IP numbers of the indoor units required to be paired are input. Wherein, it is also possible to enter a plurality of indoor units. After the input is completed, this line controller sends IPs of the line controllers and the indoor units to the CCO. After receiving the pairing information of the line controllers, the CCO forms a pairing relationship table between a plurality of line controllers and the corresponding indoor unit according to the IP of the line controller (equivalent to the identification information of the first specified line controller in the above-described embodiments) and the IPS of the devices to be paired (equivalent to the identification information of the second specified device and the identification information of the indoor unit in the above-described embodiments) that have been sent. After the pairing relationship is established, the IP list of the paired line controllers and indoor units is viewed on any paired line controller. Moreover, it is possible to delete the pairing relationship by deleting the IP of the line controller or the IP of the indoor units in the list, or to create a new pairing relationship by adding IPs of new line controllers or indoor units.

Method 2: each indoor unit is provided with one infrared receiver, so that a signal is sent to the indoor unit through the remote controller to allow a corresponding indoor unit to enter a pairing state (that is to-be-paired state), and operation is performed on a line controller required to be paired so that it enters a pairing state. Then, confirmation operation is performed on any line controller in a pairing state. After receiving a confirmation information (equivalent to the confirmation information in the above-described embodiments), the CCO pairs the indoor unit with the line controller in a pairing state and form a pairing relationship table between a plurality of line controllers and the corresponding indoor unit. After the pairing relationship is established, the remote controller is operated to send a signal to this indoor unit to delete a pairing relationship between this indoor unit and current line controllers, or the line controller is operated to cancel a pairing relationship between itself and other line controllers.

There are also other pairing methods, with the purpose to form a pairing relationship table between the line controllers and the corresponding indoor unit on the CCO. After the relationship table is established, the CCO informs that the corresponding line controllers and indoor unit are successfully paired. At this time, any one of the paired line controllers that have been paired is operated to send data to the PLC network. The CCO forwards data to the line controllers and the indoor unit paired with this line controller. Moreover, the states of other paired line controllers are also updated synchronously, thereby realizing the purpose of controlling the indoor unit by a plurality of line controllers.

It should be noted that, as shown in FIG. 2, the line controller 1 (IP is 1) and the line controller 2 (IP is 2) are required to jointly control the indoor unit 1 (IP is 3), Then, the line controller 1, the line controller 2 and the indoor unit 1 are first paired. After the pairing is completed, a pairing relationship table between IP1, IP2 and IP3 is formed on the CCO. Afterwards, the line controller 1 and the line controller 2 jointly control the indoor unit 1.

In some embodiments, the pairing relationship table is stored in the EEPROM of the CCO. Even if the system is powered off, the CCO re-reads a pairing relationship table between the line controller and the indoor unit from the EEPROM after the next power on, without having to pair again.

Figure 3:
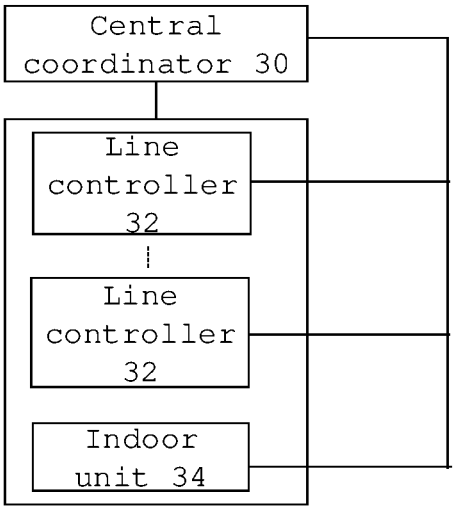
FIG. 3 is a schematic structural view of a multi-connected system according to embodiments of the present disclosure.

According to one method of embodiments of the present application, embodiments of multi-connected system are also provided. FIG. 3 is a schematic structural view of a multi-connected system according to embodiments of the present disclosure. As shown in FIG. 3, the system comprises: a central coordinator 30, a plurality of line controllers 32 and an indoor unit 34. The central coordinator 30, the plurality of line controllers 32 and the indoor unit 34 are connected to the power lines in the multi-connected system. Wherein, the central coordinator 30 stores a pairing relationship between the plurality of line controllers 32 and the indoor unit 34.

The specified line controller among the above-described plurality of line controllers 32 is configured to send data to the central coordinator 30.

The central coordinator 30 is configured to determine an indoor unit and other line controllers corresponding to the specified line controller according to the pairing relationship and the specified line controller after receiving the data, and send the data to the determined indoor unit and the other line controllers, wherein the other line controllers are other line controllers than the specified line controller among the plurality of line controllers 32.

By means of the above-described system, the central coordinator 30 determines other line controllers and the indoor unit paired with the specified line controller according to the pre-stored pairing relationship between the plurality of line controllers 32 and the indoor unit 34, thereby achieving the purpose that a plurality of line controllers control one indoor unit, thereby solving the technical problem that the multi-connected system based on PLC communication in the related art cannot meet the needs of users.

In some embodiments of the present disclosure, the specified line controller is further configured to generate a first specified signal carrying identification information of the other line controllers and identification information of the indoor unit 34, and send the identification information of the other line controllers and the identification information of the indoor unit 34 to the central coordinator; the central coordinator 30 is further configured to obtain identification information of the specified line controller and establish the pairing relationship according to the identification information of the specified line controller, the identification information of the other line controllers, and the identification information of the indoor unit.

It should be noted that, the central coordinator 30 is further configured to delete the identification information of the other line controllers and/or the identification information of the indoor unit in the pairing relationship.

In some embodiments of the present disclosure, the above-described indoor unit 34 further comprises: an infrared receiving device configured to receive a second specified signal configured to indicate that the indoor unit enters a to-be-paired state; the specified line controller is further configured to send confirmation information to the central coordinator 30, wherein the confirmation information is configured to instruct the specified line controller to confirm pairing with the other line controllers and the indoor unit; the central coordinator 30 is further configured to obtain working states of the other line controllers and the indoor unit 34, and to pair the indoor unit in the to-be-paired state and the other line controllers in the to-be-paired state with the line controller to obtain the pairing relationship, wherein the working states comprise a to-be-paired state.

It should be noted that, the infrared receiving device is further configured to receive a third instruction signal configured to instruct to delete a pairing relationship between the indoor unit 34 and the specified line controller.

It should be noted that, other line controllers are further configured to receive a fourth indication signal configured to instruct to delete a pairing relationship between the other line controllers and the specified line controller.

In some embodiments of the present disclosure, the above-described central coordinator 30 is further configured to store the above-described pairing relationship in a local electrically erasable programmable read only memory (EEPROM).

Figure 4:
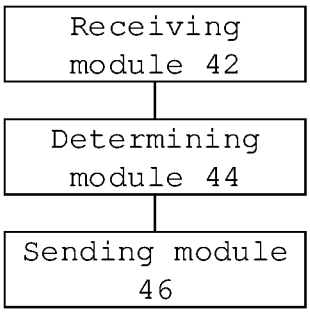
FIG. 4 is a structural block view of a data sending apparatus according to embodiments of the present disclosure.

In embodiments of the present disclosure, a data sending apparatus is provided. FIG. 4 is a structural block view of a data sending apparatus provided according to embodiments of the present disclosure. As shown in FIG. 4, the apparatus comprises:

a receiving module 42 configured to receive data sent by a first specified line controller in a system;

a determining module 44 connected to the above-described receiving module 42, and configured to determine a specified device corresponding to the first specified line controller according to a pre-stored pairing relationship between the first specified line controller and a specified device and the first specified line controller, wherein the specified device comprises an indoor unit and a second specified line controller, wherein the second specified line controller is different from the first specified line controller; and a sending module 46 connected to the above-described determining module 44 and configured to send the data to the determined specified device.

By means of the above-described apparatus, it is implemented by receiving data sent by a first specified line controller in a system; determining a specified device corresponding to the first specified line controller according to a pre-stored pairing relationship between the first specified line controller and a specified device and the first specified line controller, wherein the specified device comprises an indoor unit and a second specified line controller, wherein the second specified line controller is different from the first specified line controller; and sending the data to the determined specified device. That is, the second specified line controller and the indoor unit corresponding to the first specified line controller are determined according to the pre-stored pairing relationship between the first specified line controller and the specified device in advance, so as to achieve the purpose that a plurality of line controllers control one indoor unit, thereby solving the technical problem that multi-connected system based on the PLC communication in the related art cannot meet the needs of users.

It should be noted that, the above-described second specified line controller is one or plural and is not limited thereto.

It should be noted that, the above-described apparatus further comprises: an establishing module, which is connected to the above-described receiving module 42 and configured to establish a pairing relationship.

In some embodiments of the present disclosure, the above-described establishing module comprises: a first receiving unit configured to receive identification information of the specified device sent by the first specified line controller; a first obtaining unit connected to the above-described first receiving unit and configured to obtain identification information of the first specified line controller; a first establishing unit connected to the first obtaining unit and configured to establish a pairing relationship according to the identification information of the first specified line controller and the identification information of the specified device.

It should be noted that, the above-described identification information is a corresponding IP number, but is not limited thereto. For example, it is also a MAC address.

It should be noted that, the above-described specified device comprises: one indoor unit, and one or more second specified line controllers, but is not limited thereto.

In some embodiments of the present disclosure, the above-described apparatus further comprises: a deleting module connected to the above-described establishing module and configured to delete the identification information of the indoor unit or the identification information of the second specified line controller in the pairing relationship.

In some embodiments of the present disclosure, the above-described establishing module comprises: a second receiving unit configured to receive the instruction information sent by the first specified line controller configured to indicate that the first specified line controller is in the to-be-paired state; a second obtaining unit connected to the second receiving unit and configured to obtain a working state of the specified device in the system, wherein the working state comprises: a to-be-paired state; a third establishing unit connected to the second obtaining unit and configured to pair the specified device in the to-be-paired state with the first specified line controller to obtain a pairing relationship.

In some embodiments of the present disclosure, the above-described apparatus further comprises: a storage module connected to the above-described establishing module and configured to store the pairing relationship in a local electrically erasable programmable read only memory (EEPROM).

In embodiments of the present disclosure, a storage medium is also provided. The storage medium stores a computer program, wherein the computer program is configured to execute the steps in any one of the above-described method embodiments during operation.

In some embodiments, in the present embodiments, the above-described storage medium comprises, but is not limited to various media that store computer programs such as a USB flash drive, a read-only memory (referred thereto as ROM for short), a random access memory (referred thereto as RAM for short), a mobile hard disk, a magnetic disk, or an optical disk.

In embodiments of the present disclosure, an electronic device is also provided. The electronic device comprises a memory and a processor, wherein the memory stores a computer program, and the processor is configured to run a computer program to execute the steps in any one of the above-described method embodiments. It should be noted that, the above-described electronic device is the above-described central coordinator.

In some embodiments, the above-described electronic device further comprises a transmission device and an IN/OUT device, wherein the transmission device is connected to the above-described processor, and the IN/OUT device is connected to the above-described processor.

In some embodiments, for specific examples in the present embodiments, reference is made to the examples described in the above-described embodiments, and details are not described herein again in the present embodiments.

The serial numbers of the above-described embodiments of the present disclosure which are only for description, do not represent the superiority of the embodiments.

In the above-described embodiments in the embodiments of the present disclosure, the descriptions of the various embodiments are oriented differently, and for the parts that are not described in detail in certain embodiments, it is possible to refer to the related descriptions of other embodiments.

In several embodiments provided in the present application, it should be understood that the disclosed technical content is implemented in other methods. The device embodiments described above are merely illustrative. For example, the division of the units is a division according to a logical function, and there are other divisions in actual implementation. For example, a plurality of units or assemblies are combined or integrated into another system, or some features are ignored or not implemented. In addition, the coupling between each other or direct coupling or communication connection as displayed or discussed is indirect coupling or communication connection through some interfaces, units or modules, and is electrical or in other forms.

The units described as separate components are physically separated or not, and the components displayed as units are physical units or not. That is, they are located in one place, or are distributed on a plurality of units. Some or all of the units are selected according to actual needs to achieve the object of the solution of the present embodiments.

In addition, various functional units in various embodiments of the present disclosure are integrated into one processing unit. In some embodiments, each unit exists alone physically, or two or more units are integrated into one unit. The above-described integrated unit is implemented in the form of hardware or a software functional unit.

If the integrated unit is implemented in the form of a software functional unit and sold or used as an independent product, it is stored in one computer readable storage medium. According to such understanding, the technical solution of the embodiments of the present disclosure substantively, a part that contributes to the related art, or an entirety or part of this technical solution is embodied in the form of a software product. The computer software product is stored in one storage medium including several instructions to enable a computer device (which is a personal computer, a server, or a network device or the like) to perform all or some of the steps of the methods described in various embodiments of the present disclosure. The foregoing storage media comprise various media that store program codes such as a U disk, a read-only memory (ROM), a random-access memory (RAM), a mobile hard disk, a magnetic disk or an optical disk.

The above descriptions are only some embodiments of the present disclosure. It should be noted that: those skilled in the art also make several improvements and refinements without departing from the principles of the present disclosure, which modifications and refinements are also considered to be within the protection scope of the embodiments of the present application.

INDUSTRIAL PRACTICAL APPLICABILITY

As described above, the data sending method and apparatus, the multi-connected system, and the storage medium provided by the embodiments of the present disclosure have the following beneficial effects: a plurality of line controllers control one indoor unit, thereby solving the technical problem that the multi-connected system based on PLC communication in the related art cannot meet the needs of users.

What is claimed is:

1. A multi-connected system, comprising a central coordinator, a plurality of line controllers, and an indoor unit, which are connected to power lines of the multi-connected system, wherein:

a specified line controller among the plurality of line controllers is configured to send data to the central coordinator; and the central coordinator is configured to store a pairing relationship between the plurality of line controllers and the indoor unit, and determine an indoor unit and other line controllers corresponding to the specified line controller according to the pairing relationship and the specified line controller after receiving the data, and send the data to the determined indoor unit and the other line controllers, wherein the other line controllers are other line controllers than the specified line controller among the plurality of line controllers;

wherein the specified line controller is further configured to generate a first specified signal carrying identification information of the other line controllers and identification information of the indoor unit, and send the identification information of the other line controllers and the identification information of the indoor unit to the central coordinator; and the central coordinator is further configured to obtain identification information of the specified line controller and establish the pairing relationship according to the identification information of the specified line controller, the identification information of the other line controllers, and the identification information of the indoor unit.

2. The multi-connected system according to claim 1, wherein the central coordinator is further configured to delete at least one of the identification information of the other line controllers or the identification information of the indoor unit in the pairing relationship.

3. A multi-connected system, comprising a central coordinator, a plurality of line controllers, and an indoor unit, which are connected to power lines of the multi-connected system, wherein:

a specified line controller among the plurality of line controllers is configured to send data to the central coordinator; and the central coordinator is configured to store a pairing relationship between the plurality of line controllers and the indoor unit, and determine an indoor unit and other line controllers corresponding to the specified line controller according to the pairing relationship and the specified line controller after receiving the data, and send the data to the determined indoor unit and the other line controllers, wherein the other line controllers are other line controllers than the specified line controller among the plurality of line controllers, wherein the indoor unit further comprises an infrared receiving device configured to receive a second specified signal configured to indicate that the indoor unit enters a to-be-paired state;

the specified line controller is further configured to send confirmation information to the central coordinator, wherein the confirmation information is configured to instruct the specified line controller to confirm pairing with the other line controllers and the indoor unit; and the central coordinator is further configured to obtain working states of the other line controllers and the indoor unit, and to pair the indoor unit in the to-be-paired state and the other line controllers in the to-be-paired state with the specified line controller to obtain the pairing relationship, wherein the working states comprise the to-be-paired state, a paired state, and an unpaired state.

4. The multi-connected system according to claim 3, wherein the infrared receiving device is further configured to receive a third instruction signal configured to instruct to delete the pairing relationship between the indoor unit and the specified line controller.

5. The multi-connected system according to claim 3, wherein the other line controllers are further configured to receive a fourth indication signal configured to instruct to delete a pairing relationship between the other line controllers and the specified line controller.

* * * * *